US007780167B2

(12) United States Patent
Norman et al.

(10) Patent No.: US 7,780,167 B2
(45) Date of Patent: Aug. 24, 2010

(54) PLAYING DIE

(75) Inventors: Casey William Norman, Andoversford (GB); David Gamlin, Bath (GB); Tony Thatcher, Gillingham (GB)

(73) Assignee: Genie Toys PLC (GB)

( * ) Notice: Subject to any disclaimer, the term of this patent is extended or adjusted under 35 U.S.C. 154(b) by 991 days.

(21) Appl. No.: 11/528,018

(22) Filed: Sep. 27, 2006

(65) Prior Publication Data

US 2007/0069461 A1 Mar. 29, 2007

(30) Foreign Application Priority Data

Sep. 27, 2005 (GB) ..... 0519663.9

(51) Int. Cl.
*A63F 9/04* (2006.01)

(52) U.S. Cl. ..... 273/146; 273/138.2; 273/145 R; 273/153 J; 273/268; 463/22

(58) Field of Classification Search ..... 273/146, 273/161, 138.2, 145, 145 R, 153 J, 148 R, 273/268; 463/14, 22, 18
See application file for complete search history.

(56) References Cited

U.S. PATENT DOCUMENTS

| | | | | |
|---|---|---|---|---|
| 3,495,832 | A * | 2/1970 | Thomassen-Behle | 273/146 |
| 4,546,978 | A * | 10/1985 | David | 273/146 |
| 5,018,738 | A * | 5/1991 | Padi | 273/146 |
| 6,926,276 | B1 * | 8/2005 | Zocchi | 273/146 |
| 7,017,905 | B2 * | 3/2006 | Lindsey | 273/146 |
| 2004/0160000 | A1 * | 8/2004 | Lindsey et al. | 273/146 |

* cited by examiner

*Primary Examiner*—James S McClellan
*Assistant Examiner*—Brandon Gray
(74) *Attorney, Agent, or Firm*—DLA Piper LLP (US)

(57) ABSTRACT

A multi-sided playing die capable of indicating at least one of a plurality of symbols on sides of the die comprises an energy storage device within the die and a trigger for discharging energy from the energy storage device to cause rotation of the die out of a position in which said at least one symbol is indicated. The die may include a casing formed from parts arranged to rotate relative to each other to cause rotation of the die.

8 Claims, 3 Drawing Sheets

PLAYING DIE

RELATED APPLICATION

This application claims priority of British Patent Application No. GB 0519663.9, filed Sep. 27, 2005, herein incorporated by reference.

TECHNICAL FIELD

The invention relates to a playing die.

BACKGROUND

One or more multi-sided playing dice are widely used in games of chance, typically to generate a random number. A die is rolled or thrown and, when it comes to rest, the number or symbol on a particular face of the die, typically the uppermost face, is noted.

SUMMARY OF THE INVENTION

This invention relates to a multi-sided playing die capable of indicating at least one of a plurality of symbols on sides of the die and including an energy storage device within the die and a trigger for discharging energy from the energy storage device to cause rotation of the die out of a position in which the at least one symbol is indicated.

BRIEF DESCRIPTION OF THE DRAWINGS

A particular example of a representative structure will now be described with reference to the accompanying drawings, in which.

DETAILED DESCRIPTION

Figure 1:
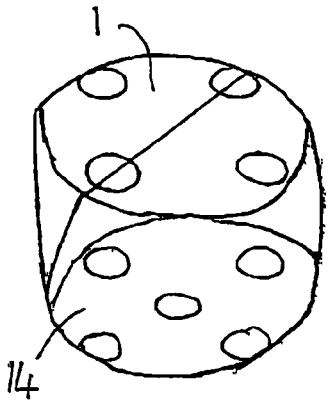
FIG. 1 shows a die according to the invention.

It will be appreciated that the following description is intended to refer to specific embodiments of the invention selected for illustration in the drawings and is not intended to define or limit the invention, other than in the appended claims.

We provide a die capable of operating in a new and surprising manner and allowing enhanced games. The die contains an energy storage device, such as a spring, which may be wound or 'loaded' prior to use. The die is then rolled like a conventional playing die before it comes to rest displaying a random number or symbol. After a variable time delay, the energy in the energy storage device is discharged, causing the die to spring up and usually to change its number or symbol at random.

We provide a multi-sided playing die capable of indicating at least one of a plurality of symbols on sides of the die and comprising an energy storage device within the die and a trigger for discharging energy from the energy storage device to cause rotation of the die out of a position in which the at least one symbol is indicated.

The die may comprise a casing formed from parts arranged to rotate relative to each other to cause rotation of the die. In particular, each part may form a half of the casing and, where the die is a cube, the parts may be divided at a plane coinciding with two diagonally opposite vertices of the die.

The energy storage device may comprise at least one helical spring.

The die may include a winder for winding the spring to store energy therein. In particular, the winder may comprise part of a casing of the die. One or more stops may be provided to limit winding of the winder, e.g., after about 360° of rotation.

The die may include a delay device for delaying activation of the trigger. The operation of the die, and, e.g., the difficulty of a game can be varied if the delay device is adjustable to change a time at which the trigger is activated. The delay device may include a piston biased towards the trigger and movable in a cylinder into which air is admissible at a predetermined rate.

Turning now to the Drawings, FIG. 1 shows a die generally having the appearance of a conventional cubic die. A casing of the die is divided into two half-casings 1, 14 at a plane coinciding with two diagonally opposite vertices of the die.

Figure 2:
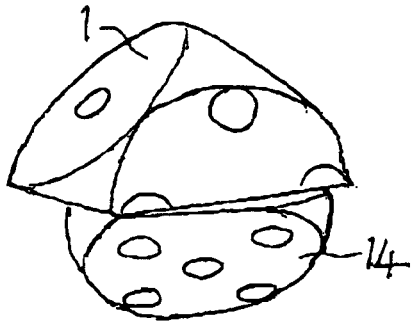
FIG. 2 shows the die of FIG. 1 in a partially-unwound state.

The die is wound by holding one of the casing halves and winding the other half relative to the held half through 360° about an axis running through the two furthest-apart apices of the halves. Once wound, the die can be rolled and will come to rest showing a value on its uppermost face. After a certain delay, the casing halves suddenly rotate relative to each other, causing the die to jump and then come to rest again, possibly with a different value uppermost. FIG. 2 shows the die in this process of unwinding.

Figure 3:
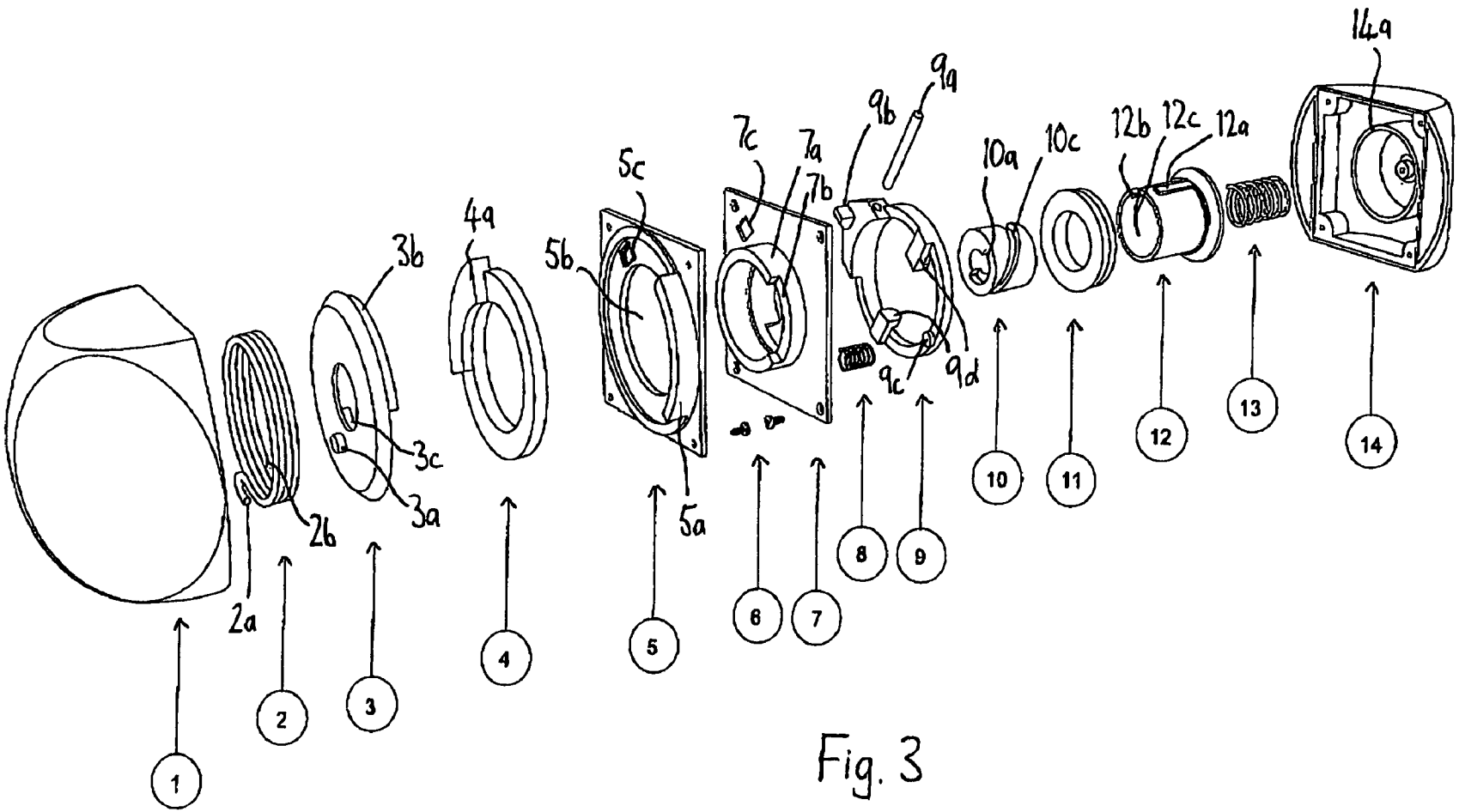
FIG. 3 is an exploded view of the die.

FIG. 3 is an exploded view of the die, certain parts being designated "left-hand" or "right-hand" with respect to the Drawings only for convenience. A main coil spring 2 is housed within the left-hand casing 1 and has a looped end 2*a* which engages with the casing 1. A second end 2*b* of the main spring engages a lug 3*a* of a disc-shaped spring drive plate 3. An end stop ring 4 is disposed between the spring drive plate 3 and a left-hand cover plate 5, which is screwed to the left-hand cover 1 by means of screws such as 6.

Spring drive plate 3 has two 90°-arcuate projections 3*b*, 3*c*, circumferentially spaced part and of different radii, facing towards left-hand cover plate 5. End stop ring 4 has a 90°-arcuate projection 4*a* facing towards drive plate 3. Left-hand cover plate 5 has a 90°-arcuate projection 5*a* facing towards drive plate 3 and ring 4 at a radius coinciding with that of an outer part of the projection 4*a*, which has a radial width also coinciding with that of projection 3*b* on drive plate 3.

Right-hand cover 7 is screwed to right-hand casing 14 and includes a cylindrical protrusion 7*a* extending through a circular aperture 5*b* in left-hand cover plate 5. An arcuate recess 7*b* in the protrusion 7*a* engages projection 3*c* on drive plate 3.

Figure 5A:
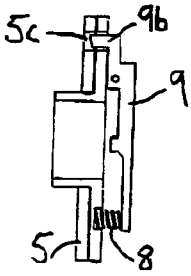
FIGS. 5*a* and 5*b* show the operation of a trigger of the die.

When the casings 1, 14 are correctly aligned, small apertures 5*c*, 7*c* in respective cover plates 5, 7 are aligned. A ring-shaped catch 9 is journalled on a pin 9*a* at one side thereof relative to right-hand casing 14. A latch member 9*b* extends from this side of catch 9 through the apertures 5*c*, 7*c* when they are aligned, as shown in FIG. 5*a*. The catch 9 is biased towards this engaged position by means of a catch spring 8 carried on a peg 9*c* and bearing against right-hand cover plate 7.

A piston arrangement of the die comprises a substantially cylindrical piston 12 arranged to slide in a cylinder 14*a* forming part of the right-hand casing 14. At its casing end, the cylinder has a needle valve 14*b*, shown in FIG. 7*a*, arranged to admit air into the cylinder 14*a* slowly. A piston spring 13 arranged in the cylinder 14*a* and biases piston 12 towards catch 9, which has barbs 9*d* for engagement by the piston 12. A resilient annular seal 11 is arranged in an annular groove in the piston. The seal 11 has a tapering cross-sectional shape, shown in FIG. 7*a*, that allows air to exit the cylinder 14*a* but not to enter it. The piston has an elongate key 12*a* along part of its length. On its inside, the piston has a small projection 12*b* adjacent an arcuate slit 12*c*.

Figure 7A:
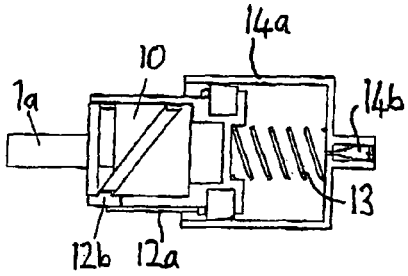
FIGS. 7*a* to 7*g* show the operation of a piston of the die.
Figure 7B:
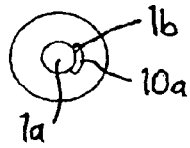
Figure 7C:
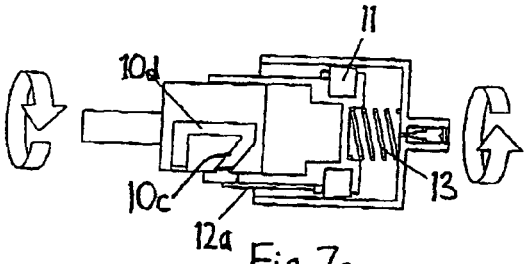

An operating helix 10, located inside the piston, comprises a cylindrical body fitted on a rotatable around a shaft 1*a*, shown in FIG. 7*a*, forming part of left-hand casing 1. A pin 1*b*, shown in FIG. 7*b*, on the shaft 1*a*, fits in an arcuate recess 10*a* on the helix 10 to restrict its relative rotation. The helix 10 has a helical track 10*c* communicating with a straight track 10*d* and an arcuate track 10*e*, shown in FIG. 7*c*. The tracks 10*c*, 10*d*, 10*e* constrain the movement of projection 12*b* on piston 12 at different parts of the operating cycle.

Figure 4A:
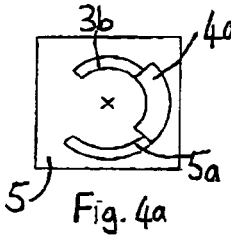
FIGS. 4*a* to 4*e* schematically show the winding of the die.
Figure 4B:
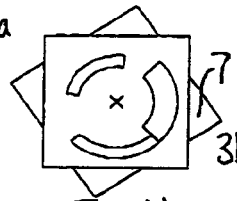
Figure 4C:
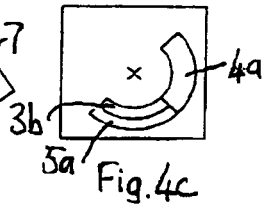
Figure 4D:
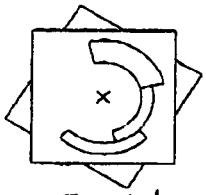
Figure 4E:
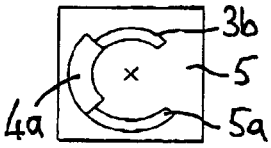

FIGS. 4*a* to 4*e* schematically show left-hand cover plate 5 with its projection 5*a* and projections 3*b* and 4*a* of spring drive plate 3 and end stopping ring 4, respectively, as the die is wound. In the starting position of FIG. 4*a*, these projections abut each other as shown. Right-hand casing 14 is then turned counterclockwise, in the view shown, relative to left-hand casing 1, and protrusion 7*a* drives spring drive plate 3 counterclockwise, storing energy in main spring 2. Projection 3*b* travels to the position of FIG. 4*c*, where it lies inside projection 5*a* and abuts projection 4*a*. As right-hand casing 14 and spring drive plate 3 continue to rotate, projection 3*b* drives end stop ring 4 around by means of projection 4*a* until the latter abuts projection 5*a* of left-hand cover plate 5 as shown in FIG. 4*e*. Thus, the two half-casings 1, 14 turn through 360° relative to each other with a stop at each end of the travel. The half-casings are retained in the fully wound position by the catch 9 as shown in FIG. 5*a*.

During the winding of right-hand casing 14, piston 12 is retracted into cylinder 14*a* as shown in FIGS. 7*a* to 7*d*. Starting from the position of FIG. 7*a*, the piston rotates together with right-hand casing 14, due to key 12*a*, in the direction shown by the arrow in FIG. 7*c*. Piston projection 12*b* moves along helical track 10*c*, moving piston 12 back and compressing piston spring 13. During this movement, air escapes from cylinder 14*a* past seal 11.

Figure 7D:
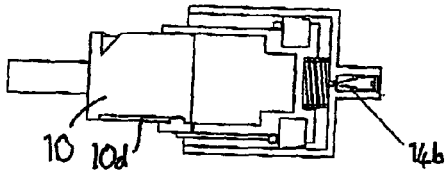

When the die is fully wound, as shown in FIG. 7*d*, projection 12*b* enters return track 10*d* of helix 10, and piston 12 can begin moving out of cylinder 14*a* with projection 12*b* sliding along return track 10*d*. As seal 11 does not admit air into cylinder 11, the rate of movement of the piston is governed by the needle value 14*b*, which admits air at a predetermined rate. This gives sufficient time for the die to be thrown and to remain apparently at rest while its position is noted.

Figure 5B:
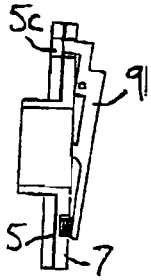
Figure 6:
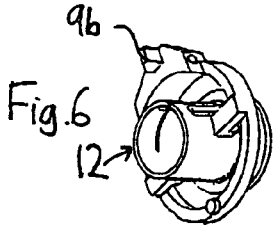
FIG. 6 shows a piston of the die inside an annular catch.
Figure 7E:
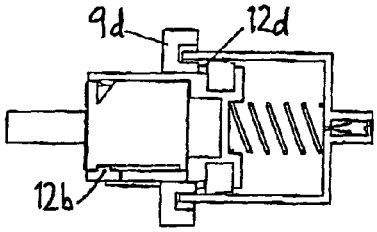

Eventually piston 12 reaches the position of FIG. 7*e*, where an annular projection 12*d* on the piston contacts barbs 9*d* of catch 9. This releases latch member 9*b* from aperture 5*c*, as shown in FIG. 5*b*, freeing left-hand cover plate 5, allowing rapid relative rotation of half-casings 1, 14 and causing the die to jump up as main spring 2 unwinds.

Figure 7F:
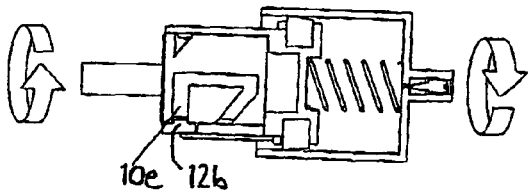
Figure 7G:
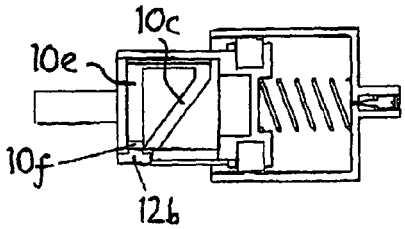

During the unwinding, projection 12*b* travels along arcuate track 10*e* as shown in FIG. 7*f* until it is forced up a ramp 10*f*, shown in FIG. 7*g*, slit 12*c* allowing radially outward movement of projection 12*b*. Projection 12*b* then drops into helical track 10*c*, as shown in FIG. 7*a*, with ramp 10*f* ensuring that on next winding the die, the projection follows helical track 10*c* rather then arcuate track 10*e*.

A simple game that can be played with the playing die is for each player to take a die, wind it and then roll. Each player then has seconds to decide whether to accept the value or to wait for the new value, calculating the odds based on both throws, what the other player is doing, and what the new value might be. Adding further dice expands the range of possible outcomes.

For each die that is used, the two numbers and the delay can be used to design and play new games of risk and chance and to play modified versions of standard games such as Snakes and Ladders or Monopoly®.

Winding through 360° is preferred when the die has the conventional shape and symbols shown, but an alternative die, possibly with different symbols, could be arranged to have another winding angle, such as 180°.

The die does not have to have the form of a cube or other regular polyhedron, but could have an irregular shape such as the shape of a human or animal figure with different sides on which the die can come to rest.

The die can be arranged to spring up and change value more than once, for example, by winding the spring to a first would position and beyond that to a second wound position.

Although this invention has been described in connection with specific forms thereof, it will be appreciated that a wide variety of equivalents may be substituted for the specified elements described herein without departing from the spirit and scope of this invention as described in the appended claims.

What is claimed is:

1. A multi-sided playing die that indicates at least one plurality of symbols on sides of the die and comprising an energy storage device within the die and a trigger that causes discharging energy from the energy storage device after a selected time period to rotate the die out of an at rest position in which the at least one symbol is indicated and which comprises at least one helical spring and a winder which comprises part of a casing of the die.

2. The die according to claim 1, comprising a casing formed from parts arranged to rotate relative to each other and rotate the die.

3. The die according to claim 2, wherein each part forms a half of the die.

4. The die according to claim 3, wherein the die is substantially a cube and the parts are divided at a plane coinciding with two diagonally opposite vertices of the die.

5. The die according to claim 1, further comprising one or more stops to limit winding of the winder.

6. The die according to claim 1, further comprising a delay device for delaying activation of the trigger.

7. The die according to claim 6, wherein the delay device is adjustable to change a time at which the trigger is activated.

8. The die according to claim 6, wherein the delay device includes a piston biased towards the trigger and movable in a cylinder into which air is admissible at a predetermined rate.

* * * * *